United States Patent [19]

Goldstein

[11] Patent Number: 4,553,275

[45] Date of Patent: Nov. 19, 1985

[54] CLEANING CLOTHS AND DISPENSERS THEREFOR

[76] Inventor: Jerome C. Goldstein, 1400 S. Joyce St., Arlington, Va. 22202

[21] Appl. No.: 606,889

[22] Filed: May 3, 1984

Related U.S. Application Data

[62] Division of Ser. No. 322,477, Nov. 18, 1981, abandoned.

[51] Int. Cl.[4] ..... A47K 3/22

[52] U.S. Cl. ..... 4/605; 4/559; 4/661; 312/42; 312/71

[58] Field of Search ..... 4/605, 661, 559; 15/104.93; 312/40, 42, 71

[56] References Cited

U.S. PATENT DOCUMENTS

| | | | |
|---|---|---|---|
| 2,976,096 | 3/1961 | Rueckert | 312/71 |
| 3,642,336 | 2/1972 | Harvey, Jr. | 312/40 |
| 3,775,801 | 12/1973 | Walker | 15/104.93 |

*Primary Examiner*—Henry K. Artis

*Attorney, Agent, or Firm*—Heslin, Watts & Rothenberg

[57] ABSTRACT

Soap-impregnated washcloths are contained in a water-impervious dispenser adapted to be mounted on a showerbath room wall for bathers' convenience.

4 Claims, 7 Drawing Figures

CLEANING CLOTHS AND DISPENSERS THEREFOR

This application is a division, of application Ser. No. 322,477, filed 11/18/81 now abandoned.

FIELD OF THE INVENTION

The present invention relates generally to the personal washing and cleaning art, and is particularly concerned with a novel assembly of soap-impregnated washcloths and a dispenser therefor mountable conveniently in a showerbath room to provide a dry supply readily accessible to a bather under the shower.

BACKGROUND OF THE INVENTION

A wide variety of personal cleaning compositions and devices have been disclosed in the prior art, including soaps, cleansers and detergents, tissues, cloths and brushes. Many of such compositions and devices in present general use have been universally accepted and used since ancient times, but the soap-impregnated medium disclosed in U.S. Pat. 1,526,149 issued Feb. 25, 1925, to Clarence S. Jackson did not prove to be a lasting success. This is because the greater convenience of such devices usually does not justify their considerably increased cost, especially in view of the short-term utility of such combinations. But apparently the practical necessity of incorporating powdered abrasive material in the soap-fabric combination of this Jackson patent was a significant additional drawback.

SUMMARY OF THE INVENTION

In accordance with this invention, a shower bather is spared the necessity of carrying soap and washcloth into the showerbath room and is likewise spared the necessity of interrupting his bath and leaving the room in order to retrieve one or the other or both. Additionally, this invention promotes cleanliness by making fresh, unused washcloths and soap for each use. This invention further makes it possible to improve upon the inherent convenience of the soap-impregnated washcloth without significantly adding to its cost. Still further, this invention provides a washcloth which by comparison with those of the prior art has special utility in showerbath application and additionally has the advantage of being useful subsequently for a variety of other washing, cleaning, sponging and scrubbing purposes although it contains none of the powdered abrasive material called for by the Jackson disclosure.

In essence, this invention centers in the novel concept of providing a supply of soap-impregnated washcloths in a showerbath room location convenient to a bather under the shower and in a container-dispenser where they are maintained fresh and dry and out of contact with shower spray. The container-dispenser is water impervious and preferably of plastic material and unitary construction, but in any event, includes a body providing a chamber in which soap-impregnated washcloths are preserved clean and dry as long as desired and yet are readily available to a bather. The dispenser body is provided with a slot through which washcloths can readily be withdrawn individually as required. As an additional feature, the body preferably has integrally-formed spray baffles or shields which are effective to prevent entry of shower spray into the region of the dispenser slot and into contact through the dispenser slot with the washcloths within the dispenser body.

This invention also embodies the new concept of providing as the washcloths of this new combination, soap-bearing open-mesh synthetic fiber sheet material on which the soap is in solid form and carried as a coating on the fibers for release on contact with water during showerbath use. These cloths are preferably of bonded rayon and of size convenient for showerbath use, and additionally bear as the soap impregnate a composition or mixture of compositions providing desired detergent, antiseptic, disinfectant, abrasive, deodorant odormask or perfume effects. The soap is in any event suitably applied to the cloth as a solid or a liquid which readily dries or cures to solid form on the cloth and serves in either application form as the vehicle for other ingredients providing one or more of the special effects noted above.

Briefly described, an assembly of this invention includes soap-impregnated washcloths and dispenser means in the form of a water-impervious body having a chamber to receive and contain the washcloths, and also having a slot opening into the chamber for sequential removal of cloths individually. In addition, the body has a substantially planar mounting surface displaced from the chamber-providing portion and in a position above the dispensing slot to bear adhesively against a wall surface in mounting the dispenser and contents in position convenient to the user. Further, the washcloths of this assembly are of open-mesh synthetic fiber sheet material bearing a soap in solid form impregnated in the sheet material and carried as a coating on the fibers thereof for release on contact with water during showerbath use.

DETAILED DESCRIPTION OF THE INVENTION

Figure 1:
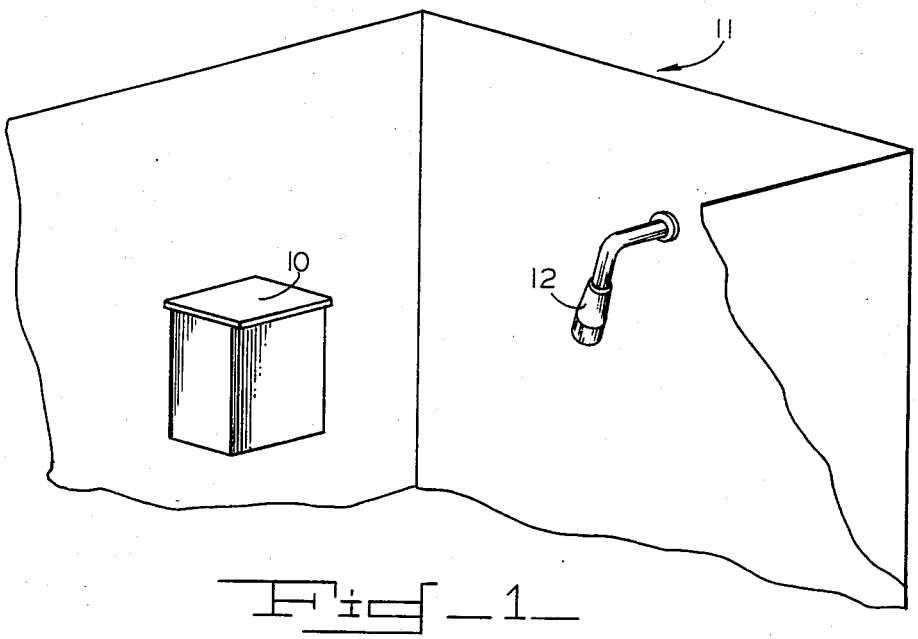
FIG. 1 is a fragmentary perspective view of a showerbath room or stall equipped with an assembly of this invention.

As shown in the drawings, assemblies of this invention have in common the unique features and advantages described above. Thus, in each of the different embodiments illustrated, the soap-impregnated washcloths are contained in a dispenser body of water-impervious material but at the same time are easily available to a shower bather who may remove them individually in fresh dry condition and ready for use. The assembly in each case has adhesive mounting means enabling secure attachment to the wall of a showerbath room.

An assembly 10 of this invention as shown in FIG. 1 is mounted in showerbath room 11 where it is within easy reach of a bather standing under a shower delivered by spray head 12. The assembly may be of any of those illustrated in FIGS. 2, 3 or 4 or another which likewise affords the new results and advantages of this invention by virtue of its design, construction and mode of operation according to the new concepts stated above.

Figure 2:
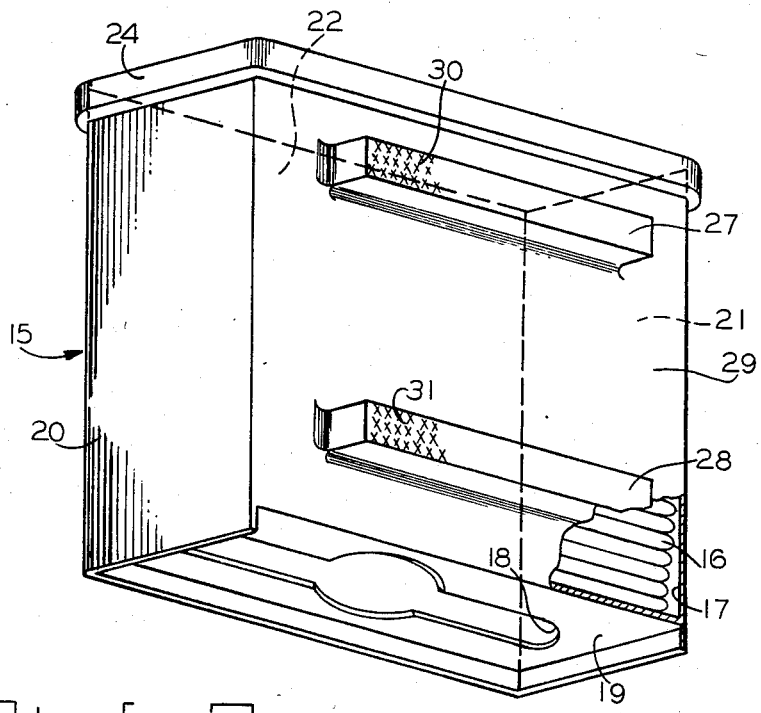
FIG. 2 is a perspective view of a preferred form of an assembly of this invention, parts being broken away for clarity.

The assembly of FIG. 2 comprises a dispenser body 15 and a plurality of soap-impregnated washcloths 16 contained in folded and stacked relation in body 15 for removal and use individually. Body 15 of suitable molded plastic material includes a chamber-providing portion 17 which is open at the top for loading and has a dispenser slot 18 formed in its bottom wall 19 through which washcloths 16 can be withdrawn in sequence. Sidewalls 20 and 21 and frontwall 22 extend below bottom wall 19 and consequently serve as water spray baffles protecting washcloths exposed through slot 18. The top of body 15 is closed by a cap piece 24, suitably a molded article of the same plastic material as the body and formed to receive the upper edges of body 15 and so prevent entry of water from the shower spray into the upper part of the washcloth chamber. Two, spaced, integrally-formed, mounting ribs 27 and 28 project from backwall 29 of body 15 and are provided with suitable pressure sensitive adhesive as indicated at 30 and 31, respectively.

Figure 3:
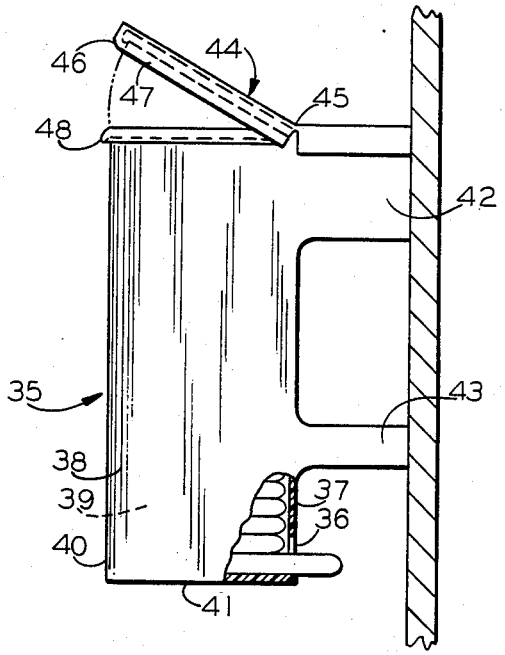
FIG. 3 is a side-elevational view of another assembly of this invention.
Figure 4:
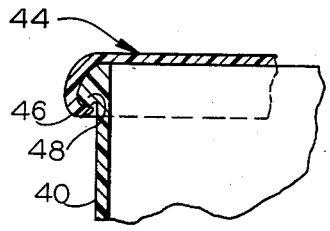
FIG. 4 is an enlarged, fragmentary view of the top closure details of the dispenser body of the FIG. 3 assembly.

The assembly of FIG. 3 differs from that of FIG. 2 mainly in the manner in which washcloths in each instance are loaded into and individually removed from the dispenser body. Thus, in the FIG. 3 embodiment, body 35 is again of molded plastic construction, but has a dispenser slot 36 for individual washcloth removal in sequence located near the lower end of backwall 37. Sidewalls 38 and 39 and frontwall 40 of the body terminate at bottom wall 41 which is just below slot 37. To permit easy access to slot 37 by a shower bather, the two spaced securing or mounting ribs 42 and 43 are of somewhat greater thickness than ribs 27 and 28 of body 15 and correspondingly greater space is thereby provided between backwall 37 and the showerbath room wall on which the assembly is mounted. Finally, the upper end of body 35 is covered by a flexible top wall piece 44 which is integrally formed and is joined only at its end 45 adjacent to rib 42, but as illustrated in FIG. 4, is formed with a lip 46 at its other end and skirt 47 along its sides. A bead 48 formed on the supper end of the frontwall 40 is engaged by lip 46 to hold top wall piece 44 in place between loading operations.

Figure 5:
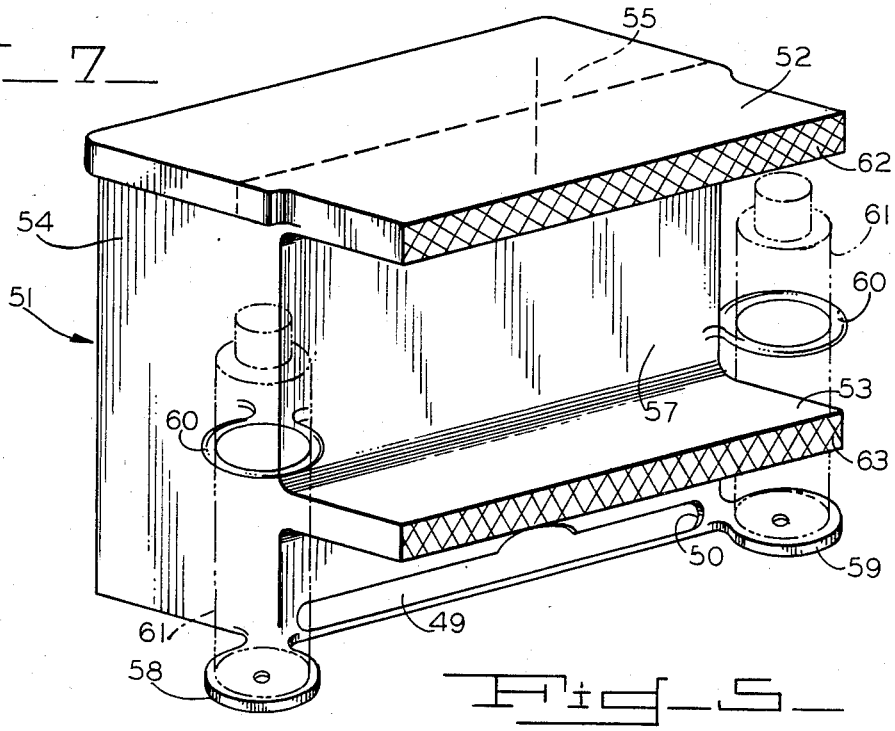
FIG. 5 is a view like that of FIG. 3 of still another assembly embodying this invention.

The assembly of FIG. 5 differs from that of FIGS. 2 and 3 mainly in respect to the means by which washcloths 49 in the dispenser chamber are protected against contact with water spray entering through dispenser slot 50. In this embodiment of the invention, body 51 which is of molded plastic material has two integrally-formed support members 58 and 59 extending laterally from the lower end portions of sidewalls 54 and 55, respectively. Spray of the shower is blocked from the region of dispenser slot 50 in the lower part of the backwall 57 by vessels 61 containing shampoos or other desired bathing preparations as these vessels rest on support members 58 and 59. Additional securing means for these vessels are provided in the form of two loops 60 integrally formed with sidewalls 54 and 55 at points about halfway between the upper and lower ends of the dispenser body. Mounting of this assembly is accomplished in the manner described in reference to the assembly of FIG. 3, adhesive material, suitably a pressure sensitive adhesive readily available on the market, is applied to the showerbath room wall-facing portion of mounting ribs 52 and 53 so that when the assembly is installed, the protective cover usually applied to the adhesive material is simply stripped away to expose the adhesive and the adhesive bearing portions 62 and 63 (on ribs 52 and 53, respectively) are pressed firmly against the dry surface of the wall where the assembly is to be located.

Figure 6:
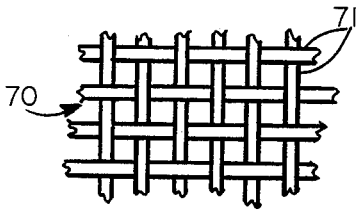
FIG. 6 is an enlarged fragmentary view of a soap-bearing washcloth embodying this invention in preferred form.
Figure 7:
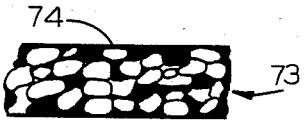
FIG. 7 is an enlarged, fragmentary view of a soap-bearing sponge embodying this invention.

It will be understood that while washcloths of a wide variety of types and sizes may be used with the dispensers of this invention, those of the novel combination assembly described above and in the appended claims afford the special new utility and other advantages of this invention. Thus, in the best practice of this invention, washcloths such as that shown in FIG. 6 are used exclusively with these new dispensers of mine. Washcloth 70 of FIG. 6 is a bonded, open-mesh, rayon cloth which carries a coating 71 on its fibers of a soap for release on contact with water during showerbath use of the cloth. Impregnation of the soap to provide coating 71 is accomplished in any suitable manner as by dipping the cloth in liquid soap or a soap suspension or emulsion, or by simply rubbing soap in solid form against the cloth to force some of the soap into the cloth mesh openings.

In actual practice, I have used as the washcloth material a product of Colgate-Palmolive Co. marketed under the trademark "Handiwipes", a 100% rayon material which, while effective to demonstrate the principles of this invention, lacks substance and abrasiveness for best results in showerbath applications. Impregnation of soap, however, was effectively and easily accomplished manually by rubbing a damp bar of soap across each side of the cloth. To demonstrate an alternative impregnation procedure, I used another proprietary product marketed under the trademark "Zest", this soap material being mixed with hot water into which the "Handiwipe" cloth was dipped and then hung to dry in air at room temperature.

An alternative to the FIG. 6 washcloth takes the form of a sponge 73 of usual washcloth size (i.e., about 12 by 12 inches) and of suitable thickness, preferably from one to 1.5 centimeters. Sponge 73 is formed of suitable plastic material having shape-maintaining and resiliency characteristics making it easy to use and effective in a variety of washing, bathing and cleaning applications. Commercially available polystyrene foam is suitable for this purpose. Like washcloth 70, however, sponge 73 of whatever material it is made carries soap 74 or the like in the recesses and on its internal and external surfaces for release on contact with water. Soap 74 is suitably applied to sponge 73 in one or the other of the ways described above in reference to the FIG. 6 article of the invention.

It will be understood that containers 60 and 61 may be integrally formed with the dispenser body instead of being separate elements as illustrated in FIG. 5 and that for convenience may be provided in each case with spring-loaded valve **60*a* and 61*a*** for fluid release by gravity and may be filled by pouring from a bulk source into the upper end of these vessels.

Those skilled in the art will understand that this invention is applicable to uses related to that specifically disclosed herein such as to dispensing of cleaning cloths useful in garages and shops where fresh, clean, dry cloths, or other specially-prepared and treated cloth materials would be provided for easy access by the user. Also, the assemblies of this invention will be useful to special advantage in such applications as commercial and domestic kitchens for pot, pan-, and utensile-cleaning purposes as well as for dish washing operations. Still further, it will be understood that the mounting means specifically disclosed above may be used as an alternative to the so-called Velcro type of microscopic hooks and eyes adhesive means of the sort commonly used as blood pressure cuff-securing attachments. This kind of attachment is likewise water resistant, but also provides secure attachment while at the same time enabling comparatively easy separation and removal of the assembly from its installed location for cleaning, replacement, repair or other purposes.

What is claimed is:

1. A showerbath room dispenser for dispensing bathing supplies comprising a molded plastic body having rigid front, back, side and bottom walls defining a washcloth chamber and a flexible integrally-formed top wall for washcloth loading access to the chamber, said back wall having a slot formed in its lower portion for dispensing washcloths individually, and means comprising a mounting rib projecting from the lower portion of the backwall and overhanging the dispenser slot for securing the dispenser to a showerbath room wall in spaced relation thereto and also for preventing water flow down the back wall to the dispesner slot.

2. The dispenser of claim 1 including two integrally formed containers for fluent bathing preparations disposed adjacent to the mounting rib and in close proximity to the side walls and the bottom wall to block wall spray and splash away from the dispenser slot.

3. For use by a bather in a showerbath room, an assembly comprising a plurality of soap impregnated washcloths and washcloth dispenser means therefor, said dispener means comprising a molded plastic body having rigid front, back, side and bottom walls defining a washcloth chamber and a flexible integrally-formed top wall for washcloth loading access to the chamber, said back wall having a slot formed in its lower portion for dispensing washcloths individually from the dispenser, and means comprising a mounting rib projecting from the lower portion of the back wall and overhanging the dispenser slot for securing the dispenser to a showerbath room wall with the back wall spaced therefrom and also for preventing water flow down the back wall and into contact with washcloths in the dispenser slot.

4. The assembly of claim 3 inlcuding two integrally-formed containers for fluent bathing preparations disposed adjacent to the mounting rib and to the bottom wall and side walls to block shower spray and splash away from washcloths exposed in the dispenser slot.

* * * * *